United States Patent [19]

Grootjans et al.

[11] Patent Number: 4,810,356

[45] Date of Patent: Mar. 7, 1989

[54] PROCESS FOR TREATING GAS OILS

[75] Inventors: Jacques F. Grootjans, Leefdaal; Pierre J. Bredael, Brussels, both of Belgium

[73] Assignee: Labofina, S.A., Brussels, Belgium

[21] Appl. No.: 10,223

[22] Filed: Feb. 3, 1987

[30] Foreign Application Priority Data

Feb. 3, 1986 [LU] Luxembourg ..... 86288

[51] Int. Cl.[4] ..... C10G 65/00

[52] U.S. Cl. ..... 208/59; 208/111

[58] Field of Search ..... 208/59, 111

[56] References Cited

U.S. PATENT DOCUMENTS

| | | | |
|---|---|---|---|
| 3,700,585 | 10/1972 | Chen et al. | 208/111 |
| 4,061,724 | 12/1977 | Grose | 423/335 |
| 4,229,282 | 10/1980 | Peters et al. | 208/111 |
| 4,292,166 | 9/1981 | Ceorring et al. | 208/59 |
| 4,347,121 | 8/1982 | Mayer et al. | 208/59 |
| 4,361,477 | 11/1982 | Miller | 208/18 |
| 4,362,653 | 12/1982 | Robinson | 252/455 R |
| 4,394,249 | 7/1983 | Shen | 208/89 |
| 4,428,825 | 1/1984 | Ward et al. | 208/111 |
| 4,428,862 | 1/1984 | Ward et al. | 208/111 |
| 4,443,329 | 4/1984 | Eberly, Jr. et al. | 208/111 |
| 4,458,024 | 7/1984 | Oleck et al. | 208/111 |
| 4,490,570 | 12/1984 | Forward et al. | 585/467 |
| 4,548,705 | 10/1985 | Young et al. | 208/111 |
| 4,561,967 | 12/1985 | Miller | 208/120 |
| 4,597,854 | 7/1986 | Penick | 208/59 |
| 4,599,473 | 7/1986 | Debras et al. | 585/467 |
| 4,648,958 | 3/1987 | Ward | 208/59 |

FOREIGN PATENT DOCUMENTS

| | | |
|---|---|---|
| 0043681 | 8/1984 | European Pat. Off. . |
| 0072220 | 4/1986 | European Pat. Off. . |

*Primary Examiner*—Curtis R. Davis

*Attorney, Agent, or Firm*—Mark A. Montgomery; William D. Jackson; John K. Abokhair

[57] ABSTRACT

A process for the treatment of a gas oil fraction to produce a lighter fraction useful as diesel fuel and/or gasoline comprising subjecting the gas oil fraction to dewaxing and mild hydracracking treatments. The dewaxing is carried out over a silicalite dewaxing catalyst. The dewaxing and mild hydrocracking treatments may be carried out sequentially or simultaneously. The gas oil feed may be passed successively through a silicalit-catalyst bed, a bed of hydrotreating catalyst and a bed of hydrocracking catalyst.

20 Claims, No Drawings

PROCESS FOR TREATING GAS OILS

The present invention relates to a process for treating gas oil feedstocks in order to produce valuable fuel products. Particularly the present invention involves a specific combination of two treatments of gas oil feedstocks in order to favor the production of diesel fuel and gasoline fractions.

The heavy gas oils (gas oils from vacuum distillation, VGO or cut between 370°-540° C.) are generally sent directly to the catalytic cracking unit in order to be converted into valuable lighter hydrocarbons. However, it is desirable to increase the yield of valuable products from gas oils, either the atmospheric gas oils or the vacuum gas oils. It has been recognized during the last few years that it is possible to treat the gas oils before submitting them to catalytic cracking in order to recover much more valuable products then solely by catalytic cracking.

It has heretofore been proposed to submit the gas oils to mild hydrocracking before subjecting them to catalytic cracking. This treatment enables the recovering of additional fractions of diesel oils.

Gas oils may also be submitted to a dewaxing process in order to reduce their pour point.

The combination of a hydrotreatment and a dewaxing has heretofore been described in the art. U.S. Pat. No. 4,394,249 to Shen discloses desulfurization of a hydrocarbon feedstock over a conventional hydrodesulfurization catalyst comprising Group VA and Group VIIIA metals, or metal oxides or sulfides, followed by dewaxing over ZSM-5 or other ZSM-type catalysts. U.S. Pat. No. 4,458,024 to Oleck et al discloses a process for hydrodewaxing and desulfurization over a single catalyst composition based upon a ZSM-5 type zeolite and Group VI and Group VIII metals. The catalyst composition may be formulated by mixing ZSM-5 with an alumina binder followed by calcining, ion exchanging to low sodium content, and impregnation with Group VI and Group VIII metal salt solutions.

European patent specification No. 43,681 (Gorring) discloses lube oil manufacturing involving dewaxing gas oils over a Ni-exchanged zeolite such as ZSM-5 or ZSM-11 in order to eliminate sulfur present in the feed, and then submitting the effluent to hydrocracking conditions. For feeds containing high levels of deleterious nitrogen compounds, a hydrotreating step may be interposed between the dewaxing and hydrocracking steps.

In European patent specification No. 72,220 (Oleck et al), base oils with low pour point are manufactured by first dewaxing the feed over a Ni-exchanged zeolite and then submitting the effluent to hydrocracking over a Ni—Mo exchanged zeolite. The zeolites may be ZSM-5, ZSM-11, ZSM-23 and ZSM-35. U.S. Pat. No. 4,229,282 to Peters discloses a process for dewaxing hydrocarbon oil in the presence of hydrogen over a Ni-W exchanged zeolite, preferably ZSM-5.

The aforementioned patents indicate that when the dewaxing and hydrocracking are combined, it is necessary to use nickel-exchanged zeolites to obtain satisfactory results in terms of pour point reduction.

An object of the invention is to provide a process for treating hydrocarbons boiling in the range of heavy gas oils, to increase the recovery of light hydrocarbons.

Another object of the present invention is to provide a two-step process for treating heavy gas oils to increase the production of diesel oils and gasoline over and above that generally obtained by catalytic cracking of the same feed.

A further object of the present invention is to provide a process for the treatment of hydrocarbons boiling in the range of 370° C.-540° C. in order to obtain a significant amount of light hydrocarbons.

In accordance with the present invention, there is provided a process for the treatment of a hydrocarbon feedstock having a distillation curve within the range of heavy gas oils in order to recover a light hydrocarbon product. The process comprises subjecting the hydrocarbon feed to a mild hydrocracking treatment and a dewaxing treatment. The dewaxing treatment is conducted over a crystalline silica polymorph silicalite dewaxing catalyst under temperature and pressure conditions suitable to crack waxy paraffinic hydrocarbons in the feedstock. The mild hydrocracking treatment is carried out over a hydrocracking catalyst at temperature and pressure conditions suitable to produce hydrocarbons of a reduced boiling point range. The hydrocracking catalyst may be of any suitable type such as a mixture of Group VIB and Group VIII metal components as described in greater detail below. Following the dewaxing and hydrocracking treatments a product of reduced boiling point having an increased amount of light hydrocarbons is recovered. The silicalite dewaxing catalyst is present in an amount within the range of 15-25 volume % of the total catalysts (including the silicalite) employed in the process.

The dewaxing and mild hydrocracking treatments may be carried out simultaneously over a blend comprising a discrete physical mixture of the silicalite dewaxing catalyst and the hydrocracking catalyst or the dewaxing and mild hydrocracking treatments may be carried out sequentially.

In a preferred embodiment of the invention, a hydrocarbon feedstock having a final boiling point in excess of 450° C. and a 25 wt.% boiling point in excess of 370° C. is passed to a reaction zone where it is dewaxed over a silicalite dewaxing catalyst. The dewaxed hydrocarbon fraction from this initial reaction zone is passed into a subsequent reaction zone where it is hydrocracked over a hydrocracking catalyst under mild operating conditions including a temperature within the range of 350° C.-450° C. and a pressure within the range of atmospheric to 80 bars. The resulting product of reduced boiling point range, which is predominantly in the diesel oil range or below, is withdrawn from this reaction zone.

In a further aspect of the invention, there is provided an intermediate reaction zone between the dewaxing and hydrocracking zones in which the hydrocarbon fraction is catalytically hydrotreated to remove sulfur. Preferably, the initial, intermediate and subsequent reaction zones are defined by respective layers of catalysts within the same reactor. The reactor is operated in a downflow mode in which the hydrocarbon feed passes in a liquid phase through the successive catalyst layers, contacting the silicalite first.

In the present invention by first submitting the hydrocarbon feedstock boiling in the range of the heavy gas oils to dewaxing over a crystalline silica polymorph of the silicalite type under suitable conditions, and submitting the resulting feed to mild hydrocracking, production of light hydrocarbons, particularly diesel oil and gasoline, is obtained, in greatly improved amounts over those reasonably expected in view of the prior art.

The feeds used in the process of the invention are heavy gas oils or vacuum gas oils (VGO), comprising the hydrocarbon fraction boiling in the range of 370° to about 540° C. These feeds may contain at most 25% by weight hydrocarbons boiling below 370° C.

The process of the invention is particularly adapted to heavy gas oils feedstocks having a sulfur content up to 5% by weight. A preferred application of the invention resides in the treatment of feedstocks having a sulfur content of at least 1 wt %, particularly within the range of 1–4 wt.%.

The best results are obtained when the dewaxing step is carried out by passing the feed over a crystalline silica polymorph of the silicalite type as catalyst, under suitable conditions to crack the straight chain paraffinic hydrocarbons.

The dewaxing catalyst used in the process of the invention is a crystalline silica polymorph of the silicalite type. Silicalite has no ion exchange capacity in comparison with aluminosilicates of the zeolite type which are silicates of aluminum and sodium and/or calcium. Aluminum may be present in silicalite, but in the form of impurity which comes from the silica source used to prepare the silicalite. Silicalites are microporous materials which are prepared hydrothermally by using a reaction mixture comprising tetrapropylammonium cations, alkali metal cations, water and a source of reactive silica. Silicalite and its preparation are described in U.S. Pat. No. 4,061,721 to Grose et al, the entire disclosure of which is incorporated herein by reference.

Silicalite in the as synthesized form and after calcining to decompose the alkyl ammonium templating agent employed in the synthesis procedure is in the orthorhombic form. However, as disclosed in U.S. Pat. No. 4,599,473 to Debras et al, silicalite of orthorhombic symmetry can be converted to monoclinic symmetry by calcining in air at a temperature of at least 600° C. for a period of 3 hours or more. Monoclinic silicalite has certain advantages in hydrocarbon conversion reactions, as disclosed in the Debras et al patent. For a description of monoclinic silicalite, its preparation and use, reference is made to the aforementioned U.S. Pat. No. 4,599,473 to Debras et al, the entire disclosure which is incorporated herein by reference. The silicalite used in the present invention can be of orthorhombic or monoclinic symmetry.

The silicalite catalyst employed in the present invention can be in the unmodified form; that is, in the form as synthesized in accordance with the procedure disclosed in U.S. Pat. No. 4,061,724 to Grose, although as noted above the silicalite may be of either monoclinic or orthorhombic symmetry. The catalyst need not be chemically pretreated to increase its stability to sulfur contaminants, and when used directly with metal catalyst components, it is in the form of a discrete physical mixture, as described in greater detail hereinafter.

Preferably in the process of the invention, the silicalite used for dewaxing has pore sizes of about 0.55 nm and is present in the form of crystallites of a size which is less than 8 microns.

The dewaxing step may be carried out in any apparatus comprising a reaction zone which contains the silicalite catalyst.

In the preferred embodiment of the invention, by directly submitting the feed which results from the dewaxing step to a mild hydrocracking, the final feed obtained contains light hydrocarbons in greater amounts then would be expected. The mild hydrocracking reaction may be carried out over any suitable hydrocracking catalyst. The classic catalysts for mild hydrocracking are mixtures of Group VIB and Group VIII metal components, particularly the oxides of such metals. An example of such catalysts is a Ni-Mo catalyst deposited on silica-alumina support. Such catalyst may be prepared by incorporating within the support Ni and Mo in the form of oxides, drying the impregnated support, and then submitting it to a stream of a mixture of $H_2$ and $H_2^S$ (1–2% vol.) at 200° C.–250° C. first and then at a temperature of 320° C.–350° C. A part of this catalyst may also be replaced by a Co-Mo catalyst deposited on an alumina support, said catalyst being prepared according to a similar method as described above. As described below, the use of a Co—Mo catalyst is desirable where the feed contains substantial sulfur, since the Co—Mo catalyst will function in a hydrotreating function to remove sulfur, as well as nitrogen components, in the feedstock. In their oxide form, these catalysts contain generally from 3–6% by weight of NiO or CoO, and from 10 14 20% by weight of $MoO_3$; these catalysts have a specific surface generally comprised between 150–300 $m^2/g$, and a pore volume generally comprised between 0.3–0.6 ml/g. These catalysts are commercially available under the form of oxide.

Although the reactions may be carried out in two different reactors in cascade and under temperature and pressure conditions which do not have to be necessarily identical, applicants have found that both reactions may be carried out in the same reactor. The proportion of the different catalysts plays a role in obtaining significant results. Thus, in a specific aspect of the invention the proportion of silicalite should be between 15–25% by volume, while the proportion of mild hydrocracking catalyst should be between 85–75% by volume. The catalysts may be placed in one or several beds which may be separated by layers of inert materials.

According to a preferred embodiment of the process of the invention, the dewaxing and hydrocracking steps of the process are carried out in the same reactor, and the different catalysts are placed in several beds. The first bed encountered the hydrocarbon feed is a bed of crystalline silica polymorph of the silicalite type. Where a hydrotreating catalyst which is effective to remove sulfur and nitrogen under the reactor conditions is employed, it preferably will be placed immediately below the silicalite catalyst bed. The hydrotreating catalyst, such as the Co-Mo catalyst described above, is separated from the silicalite catalyst by a layer of inert material, and the hydrocracking catalyst, such as the Ni-Mo catalyst described above, is placed in the reactor as a bottom layer. This catalyst will normally also be separated from the hydrodesulfurization catalyst by layer of inert material. Typically, the hydrodesulfurization and hydrocracking catalyst will be used in equal amounts, each about 40 volume % of the total catalyst volume.

The feed is passed through the reaction zone or zones containing the catalysts, at a temperature between 350° C.–450° C., preferably between 380° C.–420° C., under a pressure between atmospheric pressure and 80 bars, preferably between 35–65 bars, and at a liquid hourly space velocity (LHSV) comprised between 0.1–20 1/1 (calculated on both catalysts) and preferably between 0.5–5 1/1 $hr^{-1}$.

Simultaneously with the feed, hydrogen is introduced into the reactor in an amount to provide a volume of ratio hydrogen/hydrocarbons between 50–5000 and preferably between 250–1000 (the volume of hydrogen being determined in the gaseous state and under standard conditions). However, practically, only a small amount of hydrogen is consumed and the gas recovered at the outlet of the reactor (constituted of hydrogen and a minor amount of gaseous hydrocarbons) is generally recycled. To compensate for the hydrogen consumption, a part of recycled gas is continuously withdrawn and is replaced by hydrogen.

Applicants have also noted a synergistic effect by carrying out another embodiment of the process of the invention in which the feed is submitted to the mild hydrocracking treatment before dewaxing. This synergistic effect is much weaker when mild hydrocracking is carried out after the dewaxing, but the quality of the 250° C.–370° C. cut is better in this latter case.

In the third embodiment of the invention in which the dewaxing catalyst is mixed with the mild hydrocracking catalyst, intermediate values are obtained for the conversion rate and for the properties of the 250° C.–370° C. cut. In this embodiment of the invention, the silicalite and metallic catalysts may be physically mixed together in any appropriate manner. The resulting mixture is a discrete physical mixture in which the individual catalyst components retain their chemical identity in contrast with the catalyst systems such as disclosed in the aforementioned U.S. patent to Peters et al or British patent specification by Oleck et al in which catalysts are composited by chemical impregnation or ion exchange with a zeolite.

The following examples are given in order to better illustrate the process of the invention but without limiting its scope.

EXAMPLE 1

The employed catalysts were silicalite (available from Union Carbide and having mean pore size of about 0.55 nm and crystallite size of less than 8 um) and a catalyst comprising Ni and Mo on $Al_2O_3/SiO_2$ and having the following characteristics:

specific area: 153 $m^2/g$
pore volume: 0.53 ml/g
NiO: 3.6 weight %
$MoO_3$: 19.6 weight %

This latter catalyst was pretreated by subjecting it to a drying step at 130° C. and then to a sulfuration treatment at 54 bars with a mixture $H_2+H_2S$ (1.1 vol. %), first at 250° C. up to a partial pressure of $H_2S$ higher than 0.03 bar at the reactor exit, and then progressively up to 320° C., while keeping the partial pressure of $H_2S$ higher than 0.03 bar at the exit. The sulfided Ni-Mo catalyst contained about 10 weight % of sulfur.

A reactor having an inner diameter of 2.5 cm was charged with 20 vol. % of silicalite (height: 7 cm) and 80 vol. % (height: 28 cm) of sulfided Ni-Mo catalyst, both being disposed between two layers of inert material (height of each layer: 40 cm).

A hydrocarbon feed was passed through the reactor, this feed passing successively through the silicalite bed and the Ni-Mo catalyst bed.

This feed was a gas oil from a vacuum distillation unit having the following characteristics:

fraction up to 180° C.: 0.1 wt %
fraction 180° C.–250° C.: 2.55 wt %
fraction 250° C.–370° C.: 18.39 wt %
fraction 370°–500° C.: 64.55 wt %
fraction 500° C.+°C.: 14.41 wt %
specific gravity $d_{15/4}$: 0.91
sulfur content: 1.42 wt %
total nitrogen: 1010 ppm.
basic nitrogen: 267 ppm.

A hydrogen stream from a refinery (containing about 85% $H_2$) was passed through the reactor at a $H_2$ partial pressure of at least 40 bars, simultaneously with the feed.

The run was carried out at 405° C. and a pressure of 54 bars. The other working conditions and the conversion rates (weight percentage of the 370+° C. fraction which has been converted) are given in the following Table 1. The ratio of recycled gas/hydrocarbons was varied as a function of the LHSV of the feed in order to keep constant the flow rate of recycled gas.

TABLE 1

| Run | 1A | 1B | 1C | |
|---|---|---|---|---|
| LHSV | 0.6 | 1.0 | 1.5 | based on the whole catalysts |
| Volume ratio recycled gas/hydrocarbons | 750 | 450 | 300 | liters of gas (under normal conditions) per liter of feed |
| Conversion (%) | 51.1 | 36.6 | 21.8 | |
| Effluent composition (wt %) | | | | |
| Hydrocarbons $C_{1-2}$ | 1.66 | 1.48 | 0.91 | |
| Hydrocarbons $C_3$ | 1.73 | 1.04 | 0.47 | |
| Hydrocarbons $C_4$ | 3.78 | 2.08 | 0.93 | |
| Fraction $C_5$–180° C. (gasoline) | 14.18 | 11.16 | 6.17 | |
| Fraction 180° C.–250° C. (kerosene) | 9.01 | 6.39 | 5.74 | |
| Fraction 250° C.–370° C. (diesel fuel) | 31.51 | 28.51 | 28.06 | |
| Fraction 370° C. | 38.13 | 49.46 | 57.72 | |
| Properties of the fraction 180° C.–250° C. | | | | |
| Specific gravity $d_{15/4}$ | 0.844 | 0.847 | 0.843 | |
| Pour point (°C.) | −57 | −45 | −47 | |
| Cloud point (°C.) | −45 | −45 | −47 | |
| Properties of the fraction 250° C.–370° C. | | | | |
| Specific gravity $d_{15/4}$ | 0.893 | 0.890 | 0.890 | |
| Pour point (°C.) | −24 | −15 | −8 | |
| Cloud point (°C.) | −27 | −11 | −8 | |
| Cetane index | 41.2 | 42.5 | 44.0 | |

EXAMPLE 2

The procedure of Example 1 was repeated, but by replacing one half of the Ni-Mo catalyst with a Co-Mo alumina catalyst (commercially available as Ketjen 742). The feed was passed successively on the silicalite, the Co-Mo catalyst and the Ni-Mo catalyst beds.

The conversion yield was 48.7% with a LHSV of 0.6.

EXAMPLE 3

The procedure of Example 1 was repeated, but by inverting the catalysts, the feed passing first over the Ni-Mo catalyst and then the silicalite bed.

The results are given in Table 2.

TABLE 2

| Run | 3A | 3B | 3C |
|---|---|---|---|
| LHSV | 0.6 | 1.0 | 1.5 |
| Conversion (%) | 50.8 | 30.7 | 19.2 |
| Effluent (wt %) | | | |
| Gaseous hydrocarbons | | 4.8 | |
| Fraction $C_5$–180° C. | | 11.9 | |
| Fraction 180° C.–250° C. | | 6.9 | |
| Fraction 250° C.–370° C. | | 21.7 | |
| Fraction 370+° C. | | 54.7 | |

TABLE 2-continued

| Run | 3A | 3B | 3C |
|---|---|---|---|
| Properties of the fraction 180° C.-250° C. | | | |
| Specific gravity d15/4 | | 0.883 | |
| Pour point/cloud point (°C.) | | −45 | |
| Properties of the fraction 250°-370° C. | | | |
| Specific gravity d15/4 | | 0.890 | |
| Pour point (°C.) | | −22 | |
| Cloud point (°C.) | | −18 | |
| Cetane index | | 42.4 | |

By comparison with run 1B, it can be shown that the properties of the diesel fuel fractions are better.

Comparative experiments (hereinafter runs C1 to C9) were carried out in order to evaluate the synergistic effect resulting from the use of the process of this invention. To this end, catalysts given in the following Table 3 were tested and the conversion yields were compared with those obtained in the hereinabove described Examples.

TABLE 3

| Run no | Catalysts | LHSV | Conversion (%) |
|---|---|---|---|
| 1A | Silicalite/Ni—Mo | 0.6 | 51.1 |
| 2 | Silicalte/Co—Mo/Ni—Mo | 0.6 | 48.7 |
| 3A | Ni—Mo/silicalite | 0.6 | 50.8 |
| C1 | Silicalite | 3 | 5.6 |
| C2 | Ni—Mo | 0.6 | 34.9 |
| C3 | Ni—Mo | 0.75 | 26.9 |
| 1B | Silicalite/Ni—Mo | 1.0 | 36.6 |
| 3B | Ni—Mo/silicalite | 1.0 | 30.7 |
| C4 | Silicalite | 5 | 5.0 |
| C5 | Ni—Mo | 1.0 | 24.7 |
| C6 | Ni—Mo | 1.25 | 19.3 |
| 1C | Silicalite/Ni—Mo | 1.5 | 21.8 |
| 3C | Ni—Mo/silicalite | 1.5 | 19.2 |
| C7 | Silicalite | 7.5 | 3.4 |
| C8 | Ni—Mo | 1.5 | 18.2 |
| C9 | Ni—Mo | 1.87 | 15.3 |

These comparative runs clearly show that a synergistic effect results from the combination of a dewaxing treatment and a mild hydrocracking treatment. For instance, the data of run 3A make it possible to calculate the conversion rate resulting from the mild hydrocracking step, taking into account the conversion rate reached in run C1 for silicalite alone, as follows:

$$50.8 \times \left(1 - \frac{5.6}{100}\right) = 47.9\%$$

This result with the conversion rates of 34.9 and 26.9% obtained with runs C2 and C3 respectively.

The composition of some effluents and the properties of some fractions are given in Table 4, where they are compared with those of run 1A.

TABLE 4

| Run | 1A | C1 | C3 |
|---|---|---|---|
| Effluent composition (wt %) | | | |
| hydrocarbons C1-C4 | 7.17 | 2.99 | 1.45 |
| fraction $C_5$-180° C. | 14.18 | 3.19 | 7.58 |
| fraction 180° C.-250° C. | 9.01 | 2.28 | 7.79 |
| fraction 250° C.-370° C. | 31.51 | 17.85 | 29.29 |
| fraction 370+° C. | 38.13 | 73.69 | 53.89 |
| Properties of fraction 180° C.-250° C. | | | |
| specific gravity d15/4 | 0.844 | | 0.845 |
| pour point (°C.) | −57 | | −54 |
| cloud point (°C.) | −45 | | −45 |
| Properties of fraction 250° C.-370° C. | | | |
| specific gravity d15/4 | 0.893 | | 0.884 |
| pour point (°C.) | −24 | | −4 |
| cloud point (°C.) | −27 | | −4 |
| cetane index | 41.2 | | 43.9 |

EXAMPLE 4

A gas oil feed comprising:

fraction 370+° C.: 78.1 wt % fraction 250° C.-370° C.: 19.1 wt % fraction 180° C.-250° C.: 2.8 wt % was treated according to the process of this invention and this treatment was followed by a usual fluid catalytic cracking at 510° C., 1.7 bar and LHSV=40 on zeolite.

The recovered effluent contained (wt %)

10.6%: gas (mainly $C_3$ and $C_4$)

35.8%: gasoline (fraction $C_5$-180° C.)

10.0%: kerosene (fraction 180° C.-250° C.)

32.1%: diesel fuel (fraction 250° C.-370° C.)

7.1%: light cycle oil 2.7%: residue

By way of comparison, a feed having the same composition was subjected to a mild hydrocracking and then to a catalytic cracking under the same working conditions. The effluent contained (wt %):

8.6%: gas (mainly $C_1$-$C_3$)

38.5%: gasoline 8.5%: kerosene 30.4%: diesel fuel 9.5%: light cycle oil 3.4%: residue This example shows that more kerosene and diesel fuel are produced with the process of this invention. Furthermore, the recovered gases are more valuable.

Having described specific embodiments of the present invention, it will be understood that modification thereof may be suggested to those skilled in the art, and it is intended to cover all such modifications as fall within the scope of the appended claims.

We claim:

1. A process for the treatment of a hydrocarbon feed containing at least 1 wt.% sulfur having a distillation curve within the range of heavy gas oils comprising subjecting said hydrocarbon feed to a mild hydrocracking treatment and a dewaxing treatment to recover a product of reduced boiling point range having an increased amount of light hydrocarbons wherein:

(a) said dewaxing treatment is conducted over an unmodified crystalline silica polymorph silicalite dewaxing catalyst under temperature and pressure conditions sufficient to crack waxy paraffinic hydrocarbons in said feedstock;

(b) said mild hydrocracking treatment is carried out over a hydrocracking catalyst at temperature and pressure conditions to produce hydrocarbons of a reduced boiling point range; and (c) said silicalite dewaxing catalyst is present in an amount within the range of 15-25 volume % of the total catalysts employed in said process.

2. The method of claim 1 wherein said dewaxing and mild hydrocracking treatments are carried out simultaneously over a blend comprising a discrete physical mixture of said silicalite dewaxing catalyst and said hydrocracking catalyst.

3. A process for the treatment of a hydrocarbon feed containing at least 1 wt.% sulfur having a distillation curve within the range of heavy gas oils comprising subjecting said hydrocarbon feed to a mild hydrocracking treatment and a dewaxing treatment to recover a product of reduced boiling point range having an increased amount of light hydrocarbons wherein:

(a) said dewaxing treatment is conducted over an unmodified crystalline silica polymorph silicalite dewaxing catalyst under temperature and pressure conditions sufficient to crack waxy paraffinic hydrocarbons in said feedstock;

(b) said mild hydrocracking treatment is carried out over a hydrocracking catalyst at temperature and pressure conditions to produce hydrocarbons of a reduced boiling point range;

(c) said silicalite dewaxing catalyst is present in an amount within the range of 15–25 volume % of the total catalysts employed in said process; and (d) said dewaxing treatment and said mild hydrocracking treatment are carried out sequentially.

4. The method of claim 3 wherein said mild hydrocracking treatment is carried out initially and the effluent from said mild hydrocracking treatment is passed to said silicalite dewaxing catalyst to carry out said dewaxing treatment.

5. The method of claim 3 wherein said dewaxing treatment is carried out initially and the effluent from said dewaxing treatment is passed over said hydrocracking catalyst to implement said mild hydrocracking treatment.

6. The method of claim 5 further comprising an intermediate hydrotreating treatment between said dewaxing and said mild hydrocracking treatments wherein the effluent from said dewaxing treatment to remove sulfur therefrom is passed over a hydrotreating catalyst then the effluent from said intermediate hydrotreating treatment is passed to said mild hydrocracking treatment.

7. The process of claim 1 wherein the feed contains at least 75% of hydrocarbons having a boiling point within the range of 370° C.–540° C.

8. The process of claim 1 wherein said process is carried out at a temperature of 350° C.–450° C., a pressure of 1–80 bars, a LHSV of 0.1–20 $hr^{-1}$ and in the presence of hydrogen in such an amount that the volume ratio $H_2$/hydrocarbons is between 50–5000 standard liters per liter.

9. The process of claim 8 wherein said process is carried out at a temperature of 380° C.–420° C., a pressure of 35–65 bars, a LHSV of 0.5–5, and in the presence of hydrogen in such an amount that the volume rate $H_2$/hydrocarbons is between 250–1000 standard liters per liter.

10. The process of claim 3 wherein the steps (a) and (b) are carried out by passing the feed successively on separated beds of catalysts in the same reactor.

11. A method for the conversion of a hydrocarbon feedstock boiling in the gas oil range to produce a fraction of reduced boiling point range and reduced pour point, comprising:

(a) passing a hydrocarbon feedstock containing at least 1 wt.% sulfur and having a final boiling point in excess of 450° C. and a 25 wt.% boiling point in excess of 370° C. into a reaction zone and within said reaction zone dewaxing said fraction over an unmodified silicalite dewaxing catalyst under temperature and pressure conditions sufficient to crack waxy paraffinic hydrocarbons in said feedstock;

(b) passing the dewaxed hydrocarbon fraction from said reaction zone into a subsequent reaction zone and within said subsequent reaction zone catalytically hydrocracking said fraction in the presence of a hydrocracking catalyst under mild operating conditions including a temperature within the range of 350° C.–450° C. and a pressure within the range of atmospheric pressure to 80 bars to produce a product of reduced boiling point range which is predominantly in the diesel oil range or below; and (c) withdrawing product from said subsequent reaction zone.

12. The method of claim 11 wherein step (a) is carried out at a temperature within the range of 350° C.–450° C. and a pressure within the range of atmospheric pressure to 80 bars.

13. The method of claim 11 further comprising an intermediate hydrotreating treatment between steps (a) and (b) wherein the dewaxed hydrocarbon fraction from step (a) is passed into an intermediate reaction zone and within said intermediate reaction zone catalytically hydrotreating said hydrocarbon fraction in the presence of a hydrotreating catalyst to remove sulfur therefrom.

14. The method of claim 13 wherein said silicalite dewaxing catalyst is present in an amount within the range of 15–25 volume % and the composite of said hydrocracking and hydrotreating catalyst is present within the range of 75–85 volume % of the total of said silicalite and said hydrocracking and hydrotreating catalysts.

15. The method of claim 13 wherein said initial, intermediate and subsequent reaction zones are defined by respective layers of catalysts within the same reactor.

16. The method of claim 15 wherein said reactor is operated in a downflow mode in which the hydrocarbon feed trickles in a liquid phase downward through the successive layers of silicalite, hydrotreating catalyst and hydrocracking catalyst.

17. The method of claim 11 wherein said hydrocracking catalyst comprises a mixture of Group VIB and Group VIII metal components.

18. The method of claim 13 wherein the hydrotreating catalyst in said intermediate reaction zone comprises cobalt and molybdenum components and the hydrocracking catalyst in said subsequent reaction zone comprises nickel and molybdenum components.

19. The method of claim 18 wherein said hydrocarbon fraction is passed over said catalyst at a space velocity (LHSV) within the range of 0.5–5 $hr^{-1}$.

20. The method of claim 13 wherein the contact time of the composite of said hydrotreating and hydrocracking catalysts is greater than the contact time of said feed over said silicalite dewaxing catalyst.

* * * * *